US007004052B1

(12) United States Patent
Shu-Sui et al.

(10) Patent No.: US 7,004,052 B1
(45) Date of Patent: Feb. 28, 2006

(54) RATCHET WRENCH WITH ROTATING DISC

(75) Inventors: Lin Shu-Sui, Taichung (TW); Li Wan-Chuan, No. 1, Alley 49, Lane 23, Yi Chang E. Rd., Tai-Pin City, Taichung (TW)

(73) Assignees: A.A.G. Industrial Co. Ltd., Taichung (TW); Li Wan-Chuan, Taichung (TW)

( * ) Notice: Subject to any disclaimer, the term of this patent is extended or adjusted under 35 U.S.C. 154(b) by 0 days.

(21) Appl. No.: 10/918,027

(22) Filed: Aug. 11, 2004

(51) Int. Cl.
*B25B 13/46* (2006.01)

(52) U.S. Cl. ..... 81/63; 81/63.2

(58) Field of Classification Search ..... 81/60, 81/61, 62, 63, 63.1, 63.2
See application file for complete search history.

(56) References Cited

U.S. PATENT DOCUMENTS 3,290,969 A * 12/1966 Bergquist et al. ..... 81/63.1
4,807,500 A * 2/1989 Main ..... 81/63.1
5,537,899 A * 7/1996 Diedrich ..... 81/57.39
5,568,751 A * 10/1996 Lee ..... 81/63
6,070,499 A * 6/2000 Wisbey ..... 81/57.29
6,457,386 B1 * 10/2002 Chiang ..... 81/62
6,568,298 B1 * 5/2003 Zinck ..... 81/57.13
6,789,447 B1 * 9/2004 Zinck ..... 81/57.13

* cited by examiner

*Primary Examiner*—David B. Thomas
*Assistant Examiner*—Robert Scruggs
(74) *Attorney, Agent, or Firm*—W. Wayne Liauh

(57) ABSTRACT

A wrench comprises a ratchet device in a ratchet box portion and including a downward bar, a lateral recess having first and second walls, and a bore in communication with the recess; a rotating disc including a shaft extended into the bore, and an actuation member on one side of the shaft; and a locking member in the recess and including an outer ratchet adapted to engage with the ratchet of the handle, an inner groove for receiving and being engaged with the actuation member in the recess, and third and fourth walls at both sides of the groove, either the third or fourth wall being adapted to contact the first or second wall when the locking member pivots to one of left and right positions in the ratchet device. Rotating the rotating disc opposite to the rotation of the handle will switch a direction of exerted force.

3 Claims, 14 Drawing Sheets

RATCHET WRENCH WITH ROTATING DISC

FIELD OF THE INVENTION

The present invention relates to wrenches and more particularly to an improved ratchet wrench with a rotating disc.

BACKGROUND OF THE INVENTION

A conventional ratchet wrench with a rotating disc is shown in FIGS. 1 and 2. As shown, an enclosed box portion 101 is provided at one end of a handle 10. A ratchet device 11 is provided in the box portion 101. The ratchet device 11 comprises a bar 111 extended downwardly, a top rotating disc 112, and a ratchet wheel 113 provided between the bar 111 and the rotating disc 112. A cavity 102 is provided at an edge of the box portion 101 and in communication therewith. A locking member 12 having a ratchet side is provided in the cavity 102. A spring biased rod 13 at one side opposite the ratchet side of the locking member 12 and a direction switch 14 projected from the box portion 101 are adapted to control the pivoting of the locking member 12 for switching a direction of force exerted upon a workpiece by the handle 10. As shown in FIG. 2 specifically, after loosening a workpiece by turning the handle 10, a user may turn the rotating disc 112 to rotate the bar 111 for removing the workpiece rather than turning the handle 10 clockwise and counterclockwise alternately. This is the function of the rotating disc 112. However, the ratchet wrench is bulky due to the provision of the direction control means at one side of the ratchet device 11.

Another conventional ratchet wrench with a rotating disc having reduced size as an improvement of the above wrench is shown in FIGS. 3 to 6. As shown, an enclosed box portion 201 having a ratchet 202 around its interior surface is provided at one end of a handle 20. A ratchet device 21 is provided in the box portion 201. The ratchet device 21 comprises a bar 211 extended downwardly, a top rotating disc 212, a recess 213 provided between the bar 211 and the rotating disc 212. A locking member 22 having two ratchet sides is pivotably provided in the recess 213 by a vertical pin 25 inserted through the rotating disc 212 and the locking member 22 into a bottom of the recess 213. A spring biased rod 23 and a direction switch 24 projected from the box portion 201 are adapted to control the pivoting of the locking member 22 for switching a direction of force exerted upon a workpiece by the handle 20. As shown in FIG. 4 specifically, the right ratchet 222 of the locking member 22 is biased by the rod 23 to project to matingly engage with the ratchet 202 and the left ratchet 221 thereof is biased against a wall of the recess 213 when loosening a workpiece by counterclockwise turning the handle 20. That is, there is no space available for turning the ratchet device 21 counterclockwise. As shown in FIG. 5 specifically, after the workpiece has been loosened, the handle 20 is motionless. The right ratchet 222 of the locking member 22 is urged by the ratchet 202 to retract when the rotating disc 212 turns counterclockwise. As such, a user may rotate the rotating disc 212 counterclockwise to quickly remove the workpiece. As shown in FIG. 6 specifically, for switching force exerted upon the workpiece it is required to turn the direction switch 24 counterclockwise for projecting the left ratchet 221 of the locking member 22 to matingly engage with the ratchet 202. The counterclockwise rotation of the switch 24 is the same as that of the ratchet device 21. However, such counterclockwise rotation of the switch 24 for overcoming the elastic force of the rod 23 may also rotate the ratchet device 21. As a result, the desired direction switch is not possible. For solving this problem, the user has to use the other hand to hold the rotating disc 212 or the bar 211 for fixing the ratchet device 21 to prevent its rotation when turning the switch 24 counterclockwise. As an end, the purpose of turning the switch 24 and the ratchet device 21 in the same direction for direction switch can be achieved. However, such ratchet wrench also has the problem of inconvenience in use despite its reduced size. Thus, the need for improvement still exists.

SUMMARY OF THE INVENTION

It is an object of the present invention to provide a ratchet wrench comprising a handle including an enclosed box portion at one end, the enclosed box portion having a ratchet around its interior surface; a ratchet device provided in the box portion and including a bar extended downwardly, a laterally disposed recess having internal first and second walls, and an axial first bore in communication with the recess; a rotating disc including a shaft extended downwardly into the first bore, and an actuation member provided on one side of the shaft; and a locking member provided in the recess and including an outer ratchet adapted to engage with the ratchet of the handle, an inner groove for receiving and being engaged with the actuation member in the recess, and third and fourth walls provided at both sides of the groove, either the third wall being adapted to contact the first wall or the fourth wall being adapted to contact the second wall when the locking member pivots to one of left and right positions in the ratchet device.

In one aspect of the present invention, rotating the handle will cause the ratchet of the handle to matingly engage with the ratchet of the locking member for pivoting the locking member to engage with either the first or the second wall so as to rotate the ratchet device and thus the workpiece. Also, rotating the rotating disc will cause the shaft to pivot the locking member for engaging with either the first or the second wall so as to rotate the ratchet device and thus the workpiece.

In another aspect of the present invention, clockwise rotating the rotating disc will inhibit the same clockwise rotation of the ratchet device due to engagement with the ratchet of the handle. Also, a continuous clockwise rotation of the rotating disc will clockwise pivot both the actuation member and the locking member until the fourth wall contacts the second wall. This finishes the switching of direction of exerted force.

The above and other objects, features and advantages of the present invention will become apparent from the following detailed description taken with the accompanying drawings.

DETAILED DESCRIPTION OF THE PREFERRED EMBODIMENTS

Figure 1:
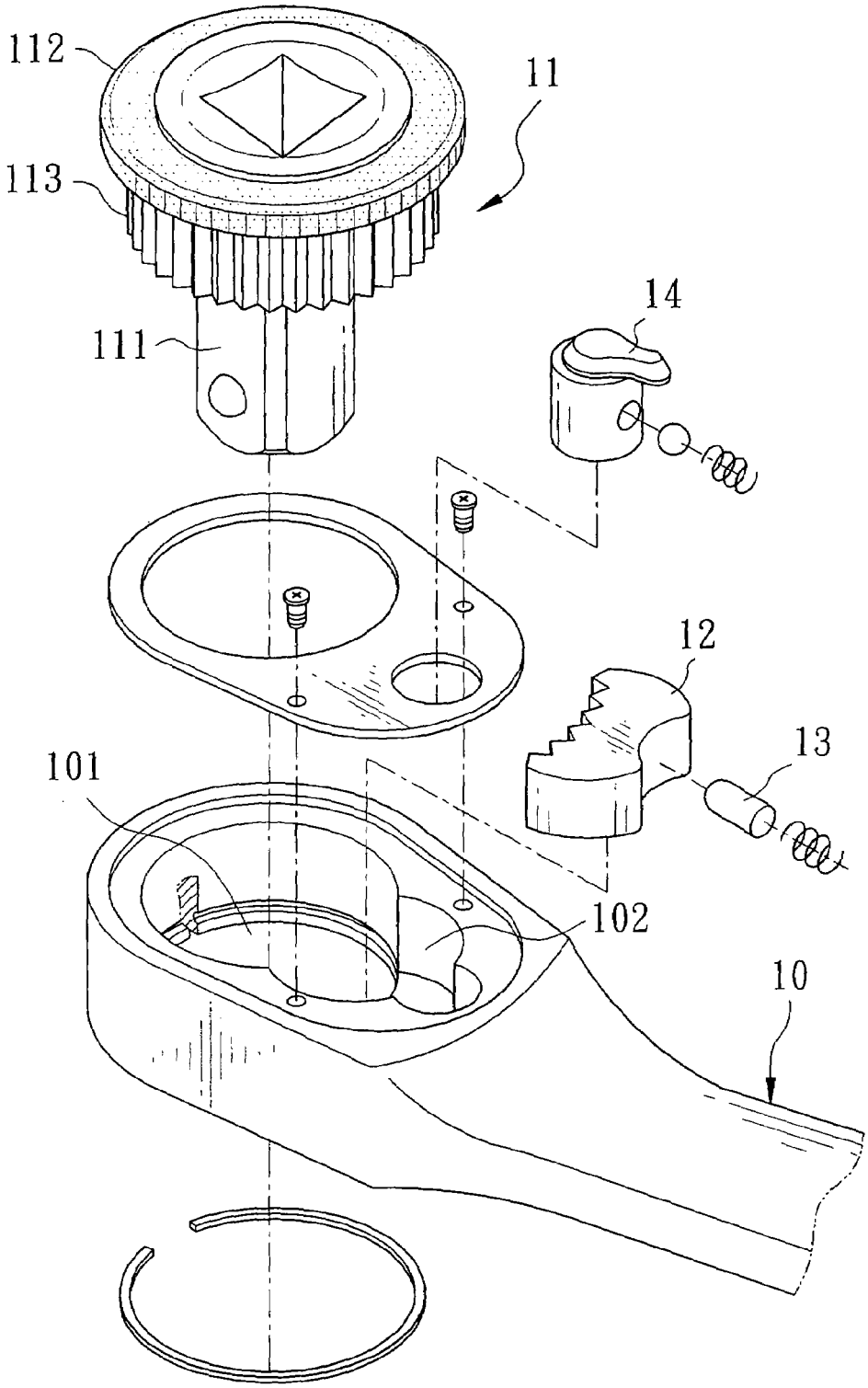
F I G . 1 PRIOR ART
FIG. 1 is an exploded view of a conventional ratchet wrench with a rotating disc.
Figure 2:
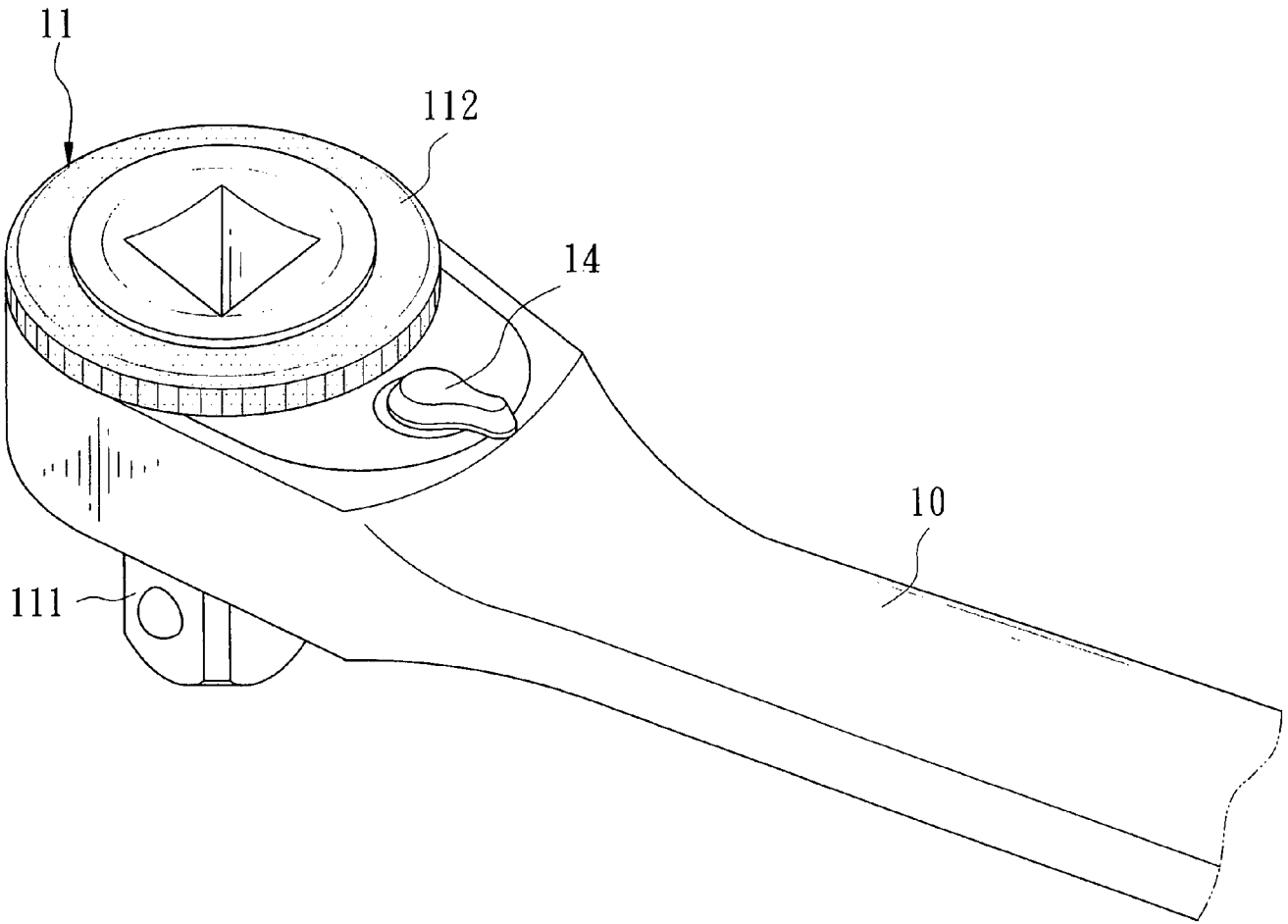
FIG. 2 PRIOR ART
FIG. 2 is a perspective view of the assembled wrench of FIG. 1.
Figure 3:
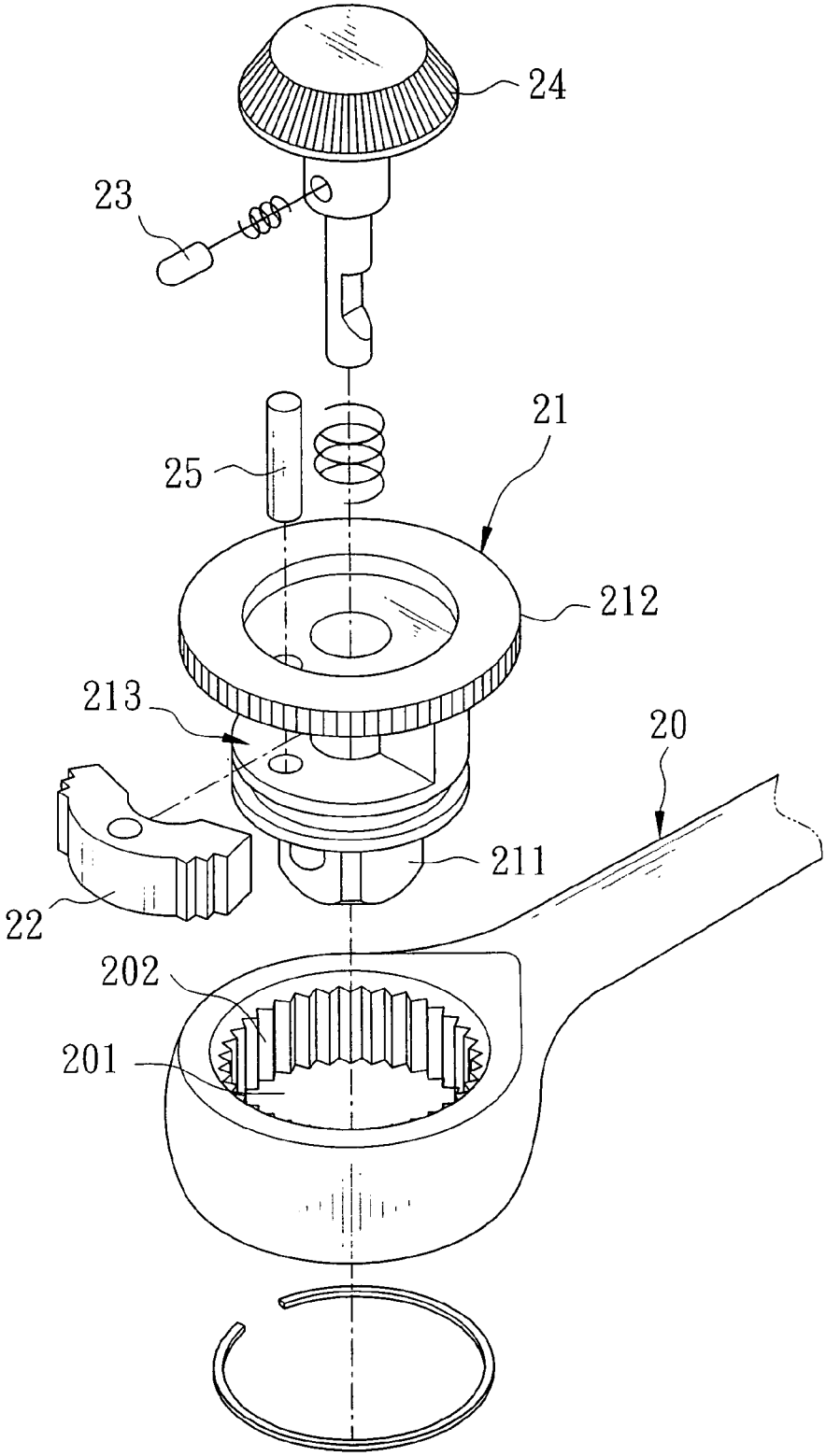
F I G . 3 PRIOR ART
FIG. 3 is an exploded view of another conventional ratchet wrench with a rotating disc.
Figure 4:
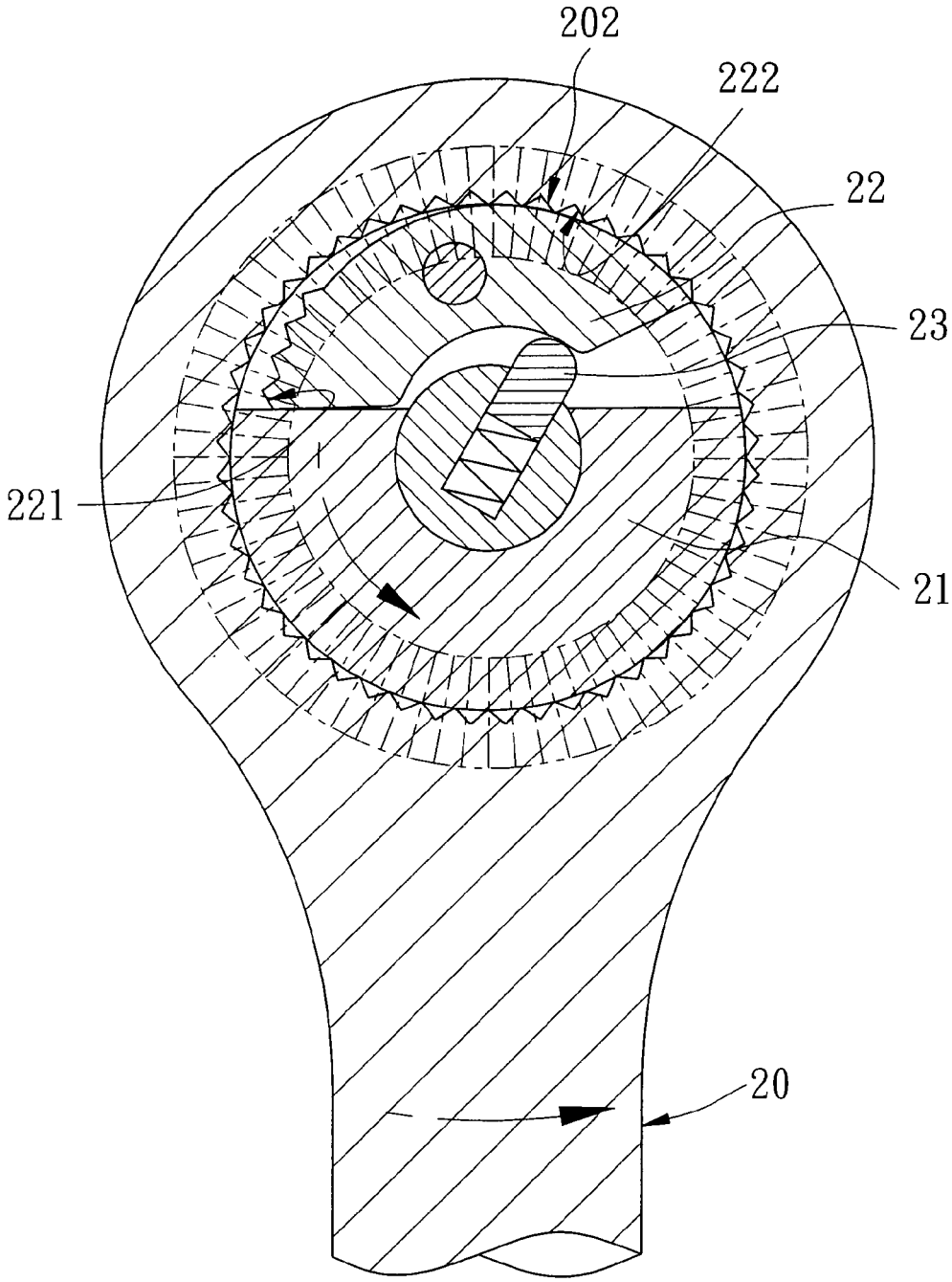
F I G . 4 PRIOR ART
FIG. 4 is a sectional view of the assembled wrench of FIG. 3 for illustrating a turning of workpiece by rotating the handle.
Figure 5:
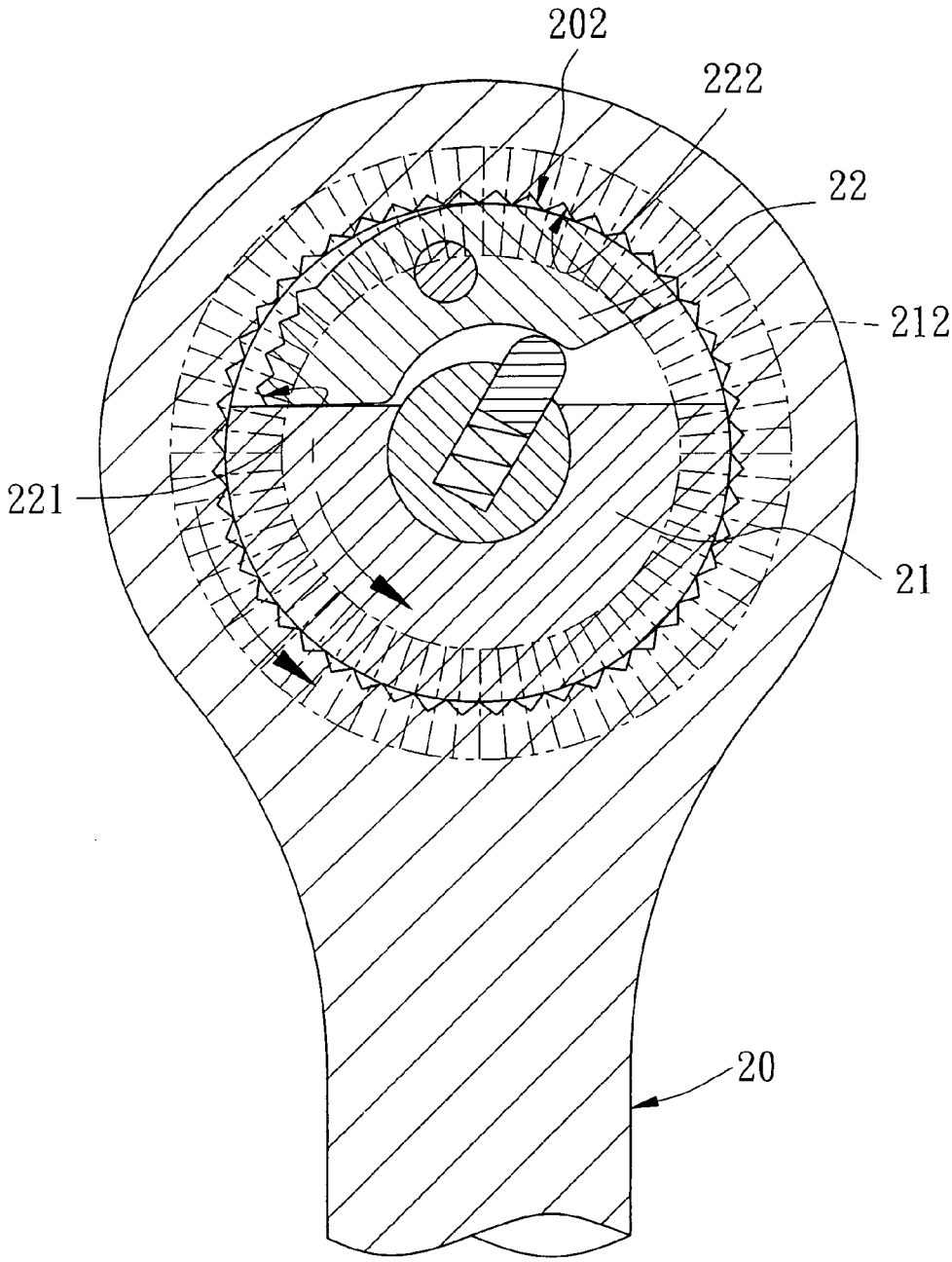
F I G . 5 PRIOR ART
FIG. 5 is a view similar to FIG. 4 for illustrating a turning of the rotating disc.
Figure 6:
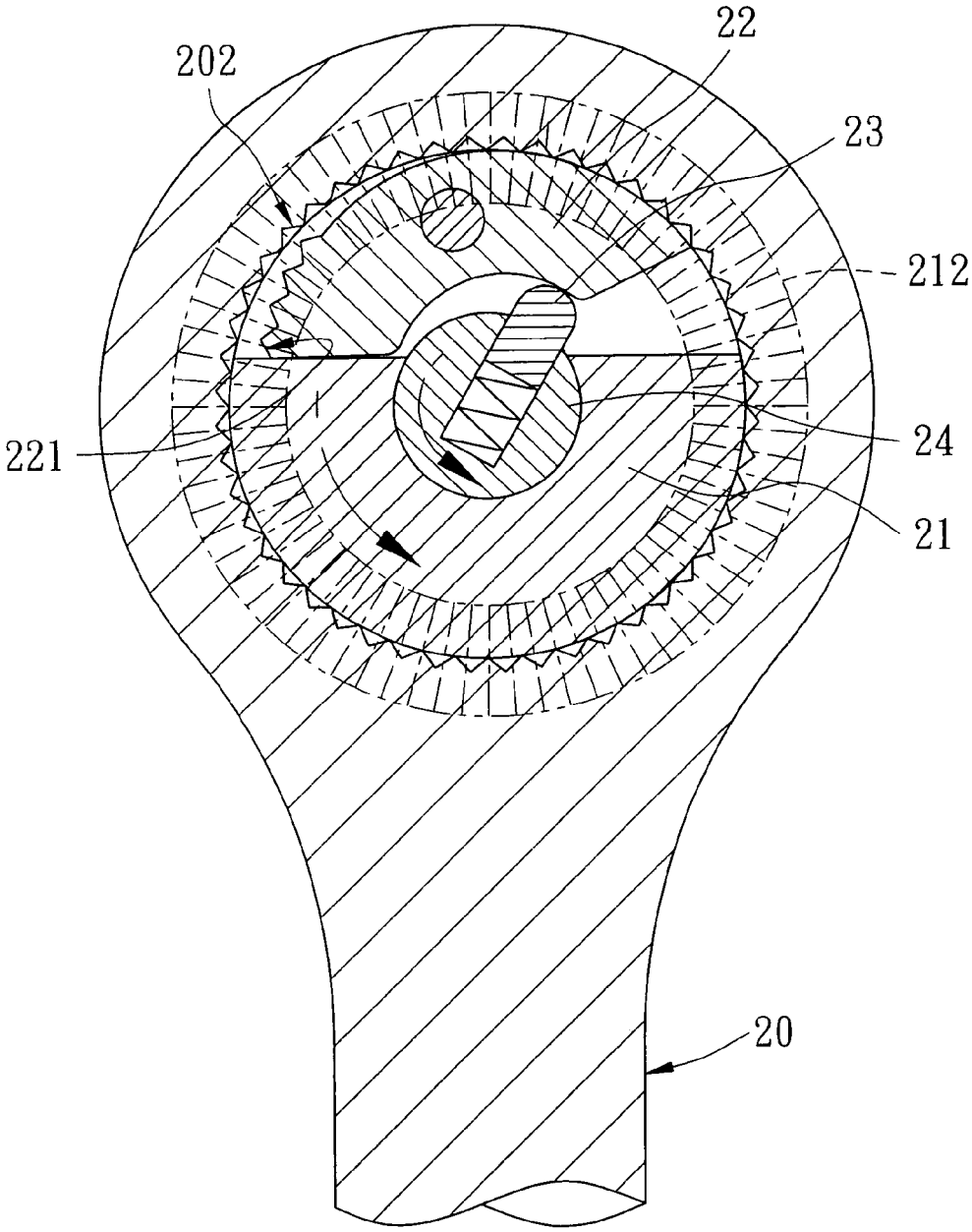
F I G . 6 PRIOR ART
FIG. 6 is a view similar to FIG. 4 for illustrating an operation of switching direction of exerted force.
Figure 7:
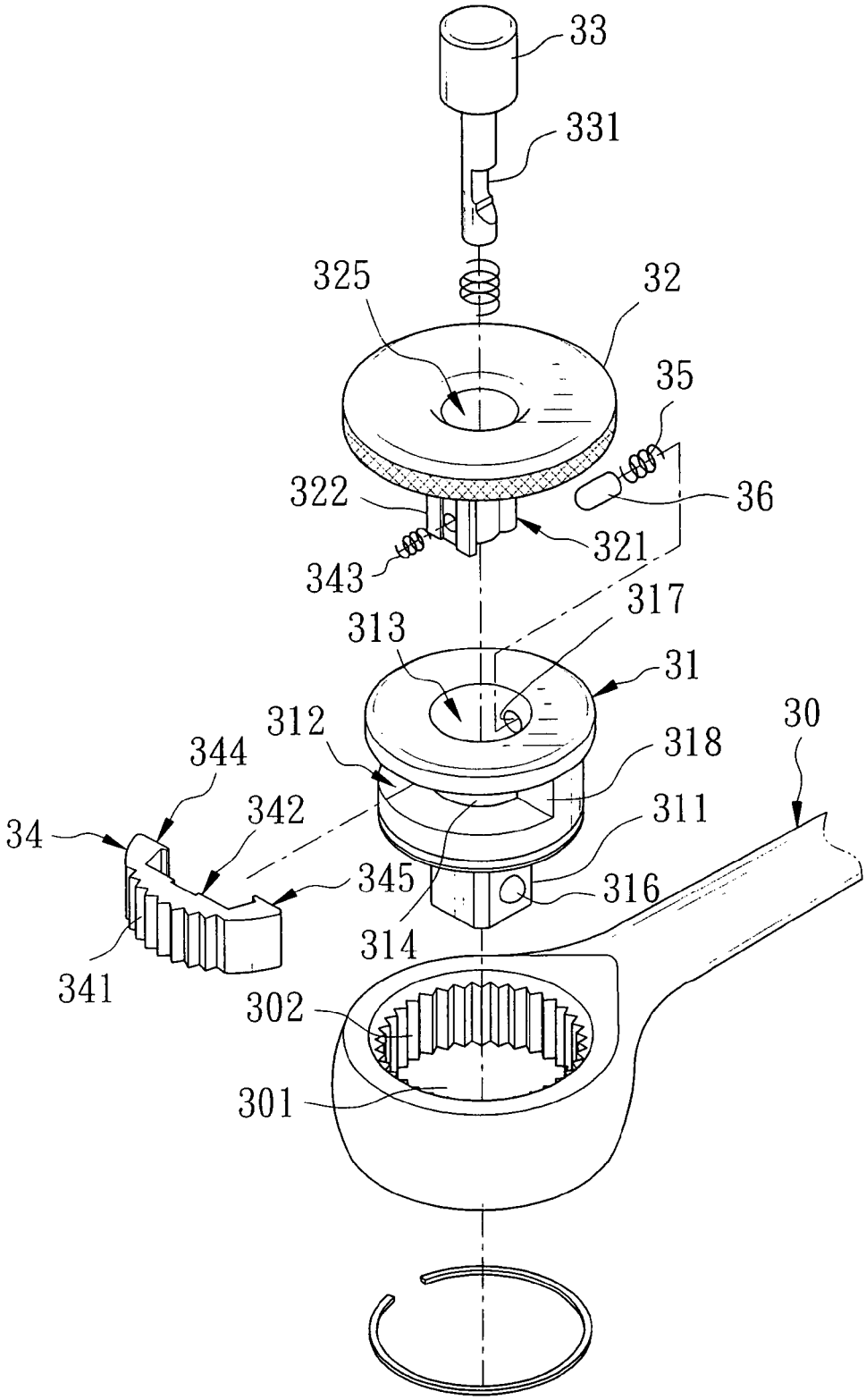
FIG. 7 is an exploded view of a preferred embodiment of ratchet wrench with a rotating disc according to the invention.
Figure 8:
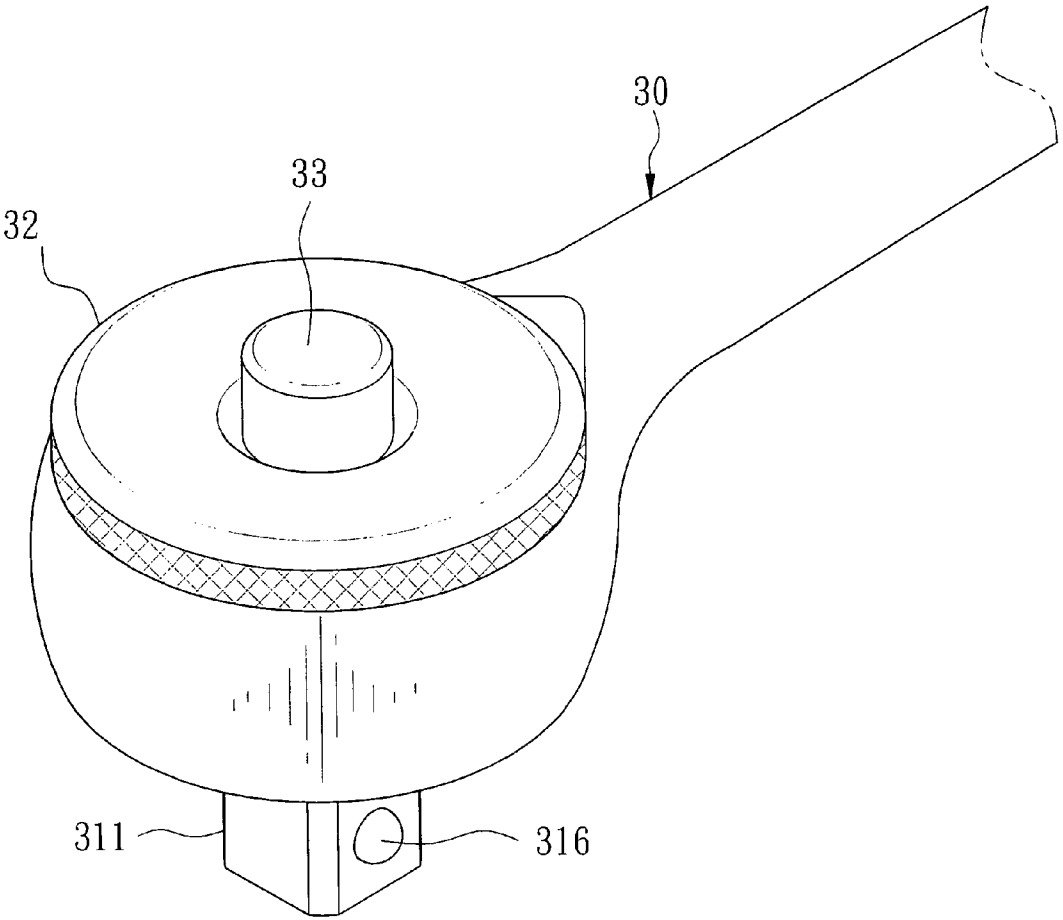
FIG. 8 is a perspective view of the assembled wrench of FIG. 7.
Figure 9:
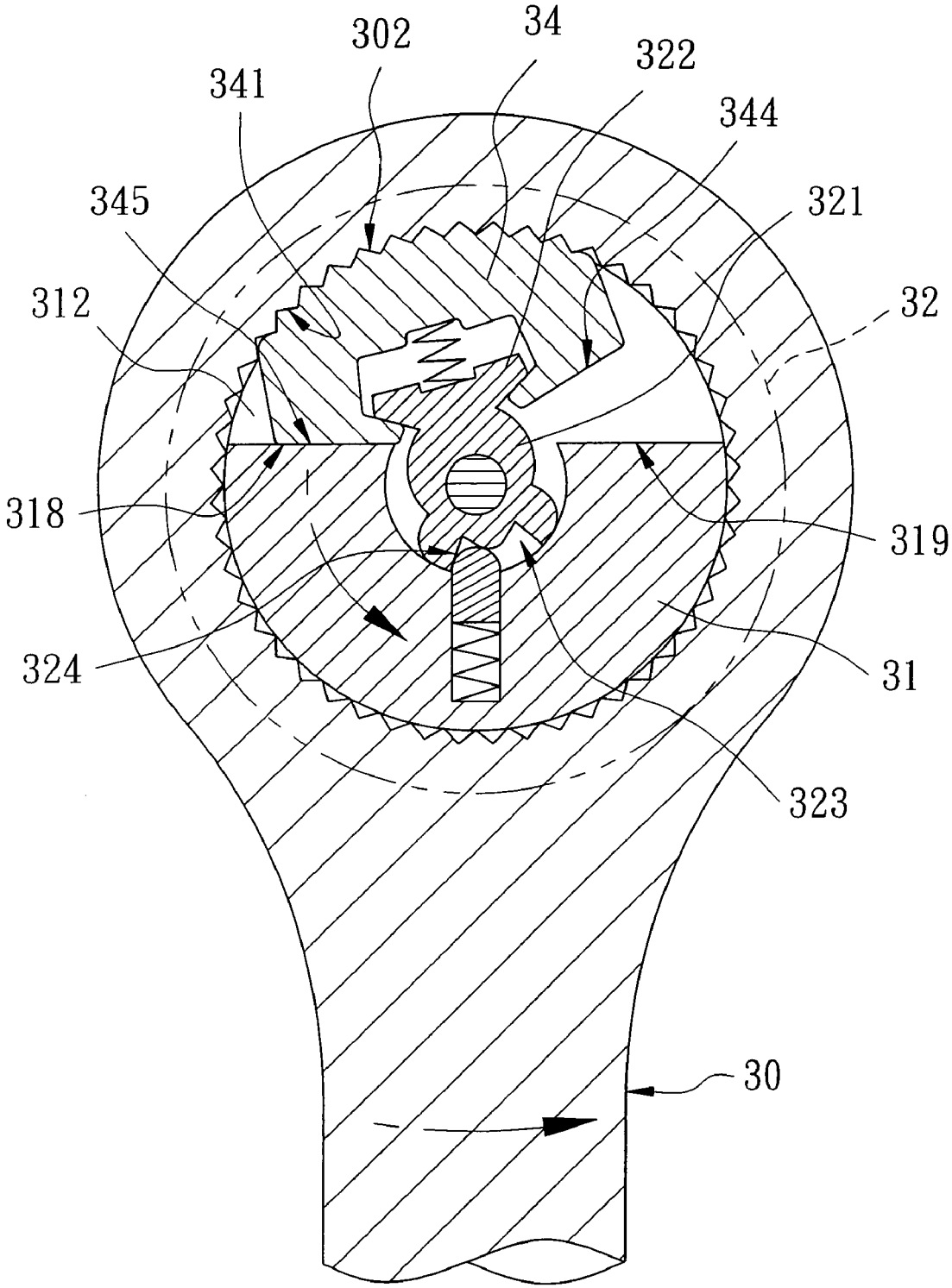
FIG. 9 is a sectional view of the wrench of FIG. 8 for illustrating a turning of workpiece by counterclockwise rotating the handle.

Referring to FIGS. 7, 8 and 9, there is shown a ratchet wrench constructed in accordance with a preferred embodiment of the invention. As shown, an enclosed box portion 301 having a ratchet 302 around its interior surface is provided at one end of a handle 30. A ratchet device 31 is provided in the box portion 301. The ratchet device 31 comprises a bar 311 extended downwardly, a laterally disposed recess 312 in a main portion thereof, the recess 312 having internal walls 318 and 319, a first bore 313 having a larger diameter in communication with the recess 312, a second bore 314 having a smaller diameter in communication with the first bore 313 and extended downwardly along a center of the bar 311, a spring biased ball 316 provided on a side of the bar 311, a receptacle 317 provided on an interior surface of the first bore 313 and being opposite the recess 312, and a spring 35 and a detent 36 both anchored in the receptacle 317.

A rotating disc 32 comprises a shaft 321 extended downwardly into the first bore 313, an actuation member 322 provided on one side of the shaft 321, two slots 323 and 324 provided on the opposite side of the shaft 321 in which the detent 36 is adapted to engage with either one of the slots 323 and 324 for positioning when the rotating disc 32 rotates, a bore 325 extended downwardly along a center of the shaft 321, a spring biased pushing rod 33 provided in the bore 325, and an indentation 331 provided on a downward peg of the pushing rod 33 for receiving the ball 316. This is a well known arrangement for quick disengagement of the bar 311 from a sleeve (i.e., workpiece). Thus, a detailed description thereof is omitted herein for the sake of brevity.

A crescent shaped locking member 34 is provided in the recess 312 and comprises a ratchet 314 provided along its outer surface, a groove 342 provided along its inner surface for receiving and being engaged with the actuation member 322 in the recess 312, a spring 343 compressed between the groove 342 and the actuation member 322, and two walls 344 and 345 provided at both sides of the groove 342. The wall 344 is adapted to contact the wall 319 or the wall 345 is adapted to contact the wall 318 when the locking member pivots to one of two extreme positions in the ratchet device 31.

Referring to FIG. 9 specifically, a workpiece loosening operation will be described in detailed below. First, rotate the rotating disc 32 and thus the actuation member 322 to pivot the locking member 34 to the left. The wall 345 then contacts the wall 318. A counterclockwise rotation of the handle 30 will cause the ratchet 302 to matingly engage with the ratchet 341. As such, the ratchet device 31 rotates counterclockwise due to the engagement of the walls 318 and 345. As an end, the workpiece can be loosened.

Figure 10:
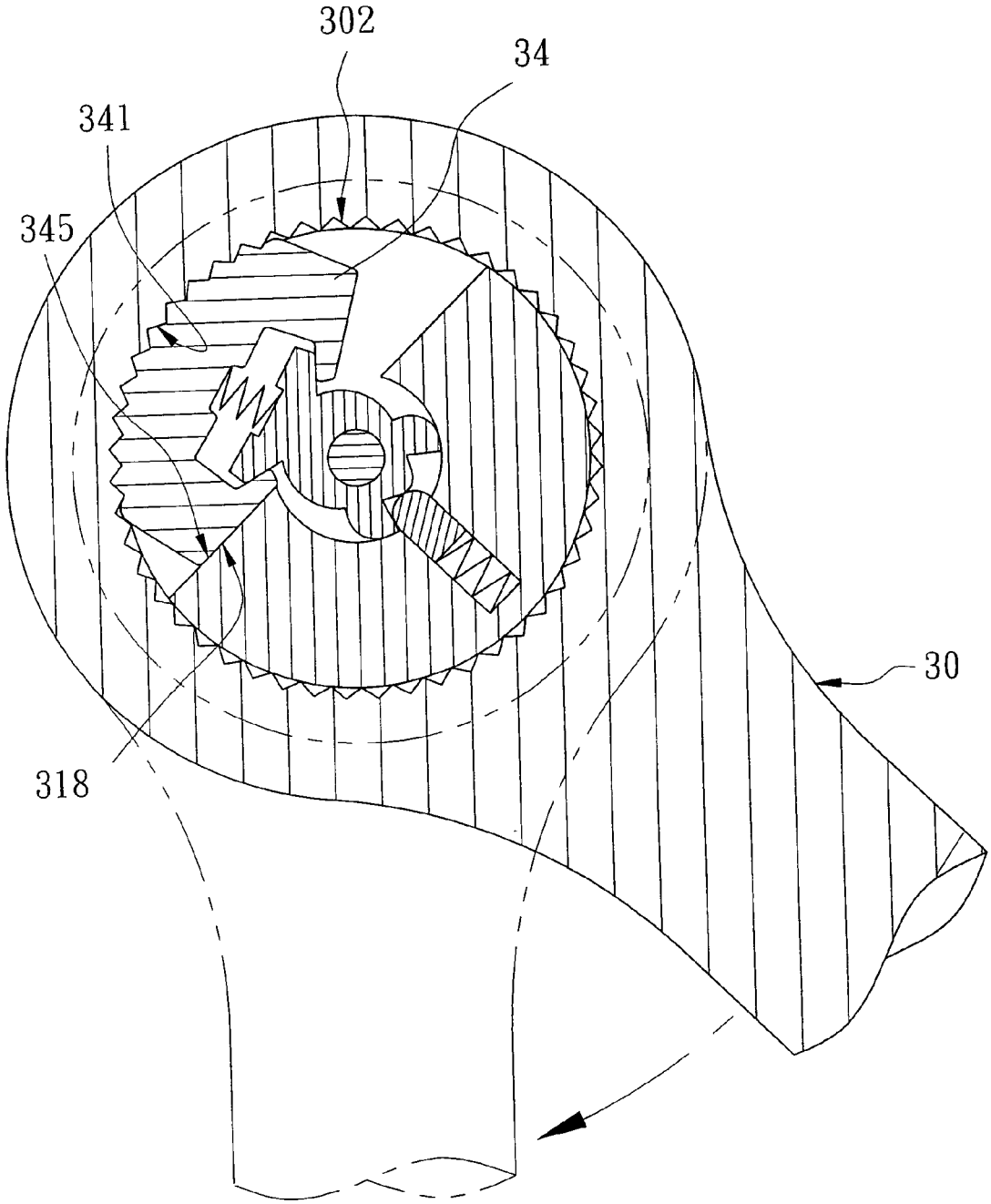
FIG. 10 is a view similar to FIG. 9 for illustrating a clockwise turning of the handle.

Referring to FIG. 10, a clockwise rotation of the handle 30 will cause the ratchet 302 to matingly engage with the ratchet 341. At this position, the right side of the ratchet 341 is not blocked and is adapted to pivot clockwise. As such, both the ratchet 302 and the ratchet 341 pivot clockwise. As a result, a continuing clockwise rotation of the handle 30 will loosen the workpiece.

Figure 11:
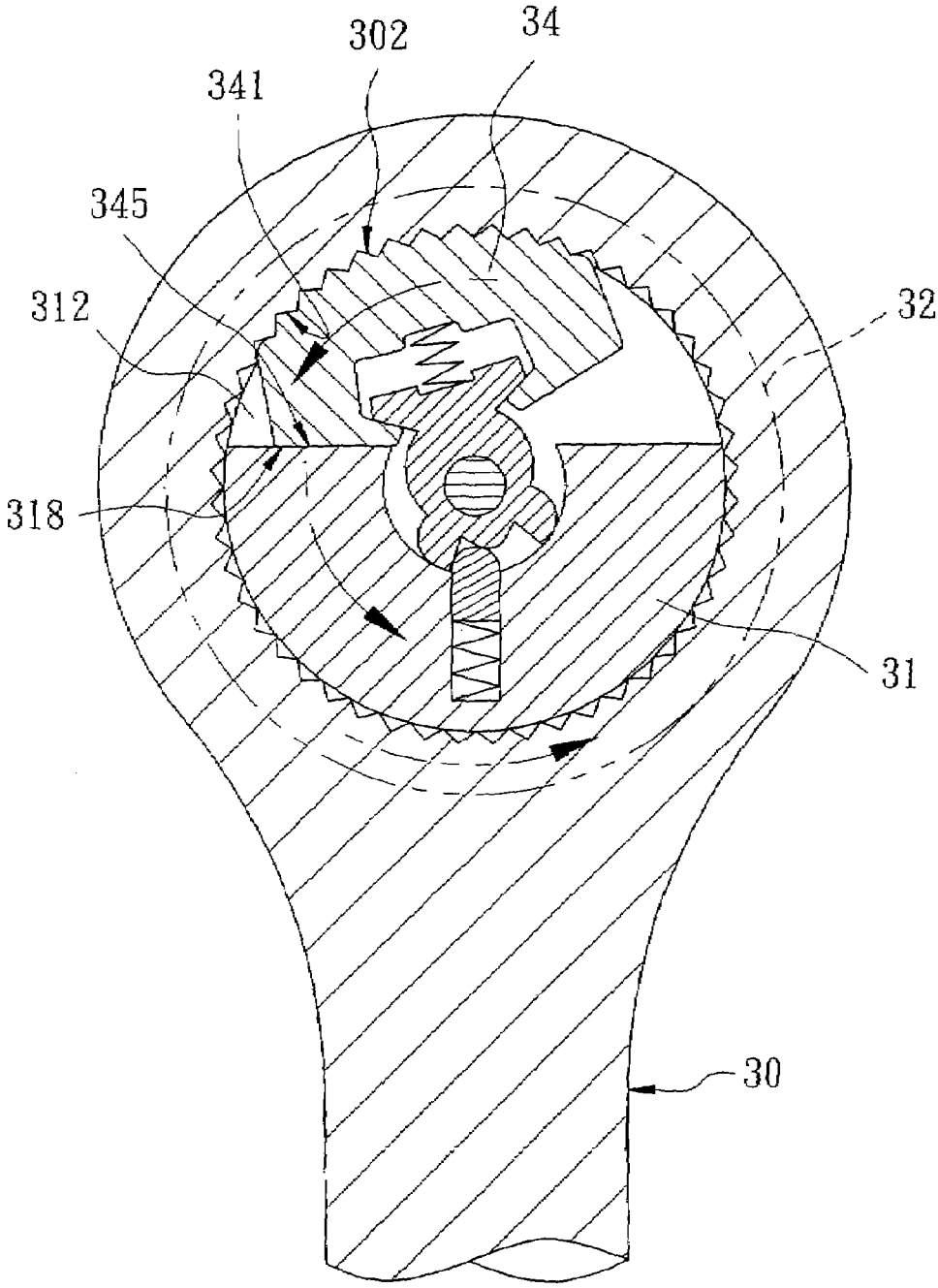
FIG. 11 is a view similar to FIG. 9 for illustrating a turning of the rotating disc.

Referring to FIG. 11, after loosening the workpiece a user may counterclockwise rotate the rotating disc 32 to remove the workpiece quickly. The wall 345 then contacts the wall 318. As such, the ratchet device 31 rotate counterclockwise. Also, the right side of the ratchet 341 is not blocked. As such, both the ratchet 302 and the ratchet 341 pivot counterclockwise. As a result, the workpiece can be removed quickly.

Figure 12:
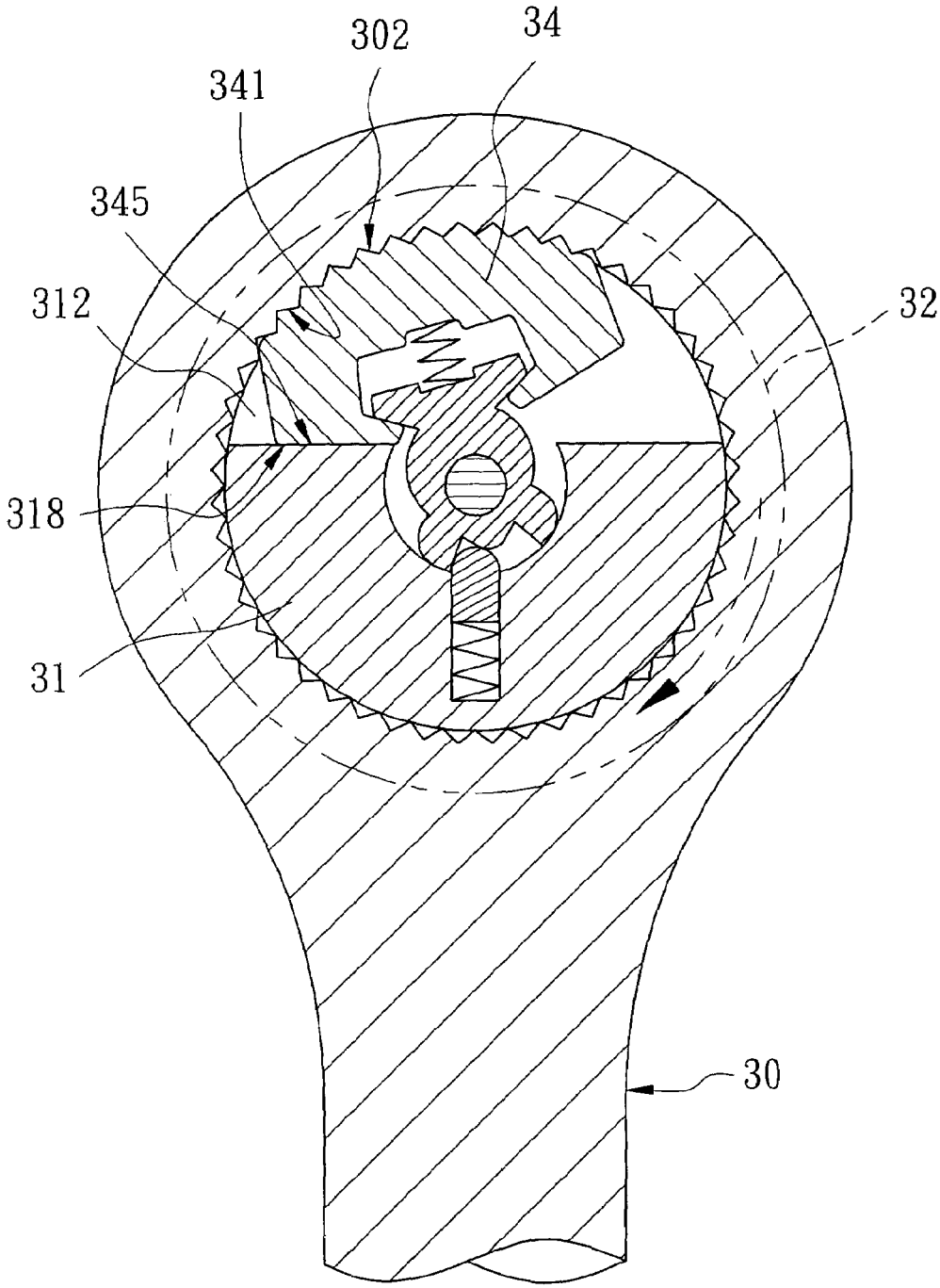
FIG. 12 is a view similar to FIG. 9 for illustrating an inhibition of the ratchet device by turning the rotating disc.

Referring to FIG. 12, in the process of loosening the workpiece a clockwise rotation of the rotating disc 32 will inhibit the same clockwise rotation of the ratchet device 31 due to the ratchet 302. As such, the wall 345 remains in contact with the wall 318. As a result, a clockwise rotation of the rotating disc 32 cannot clockwise rotate the ratchet device 31 (i.e., the ratchet device 31 is locked).

Figure 13:
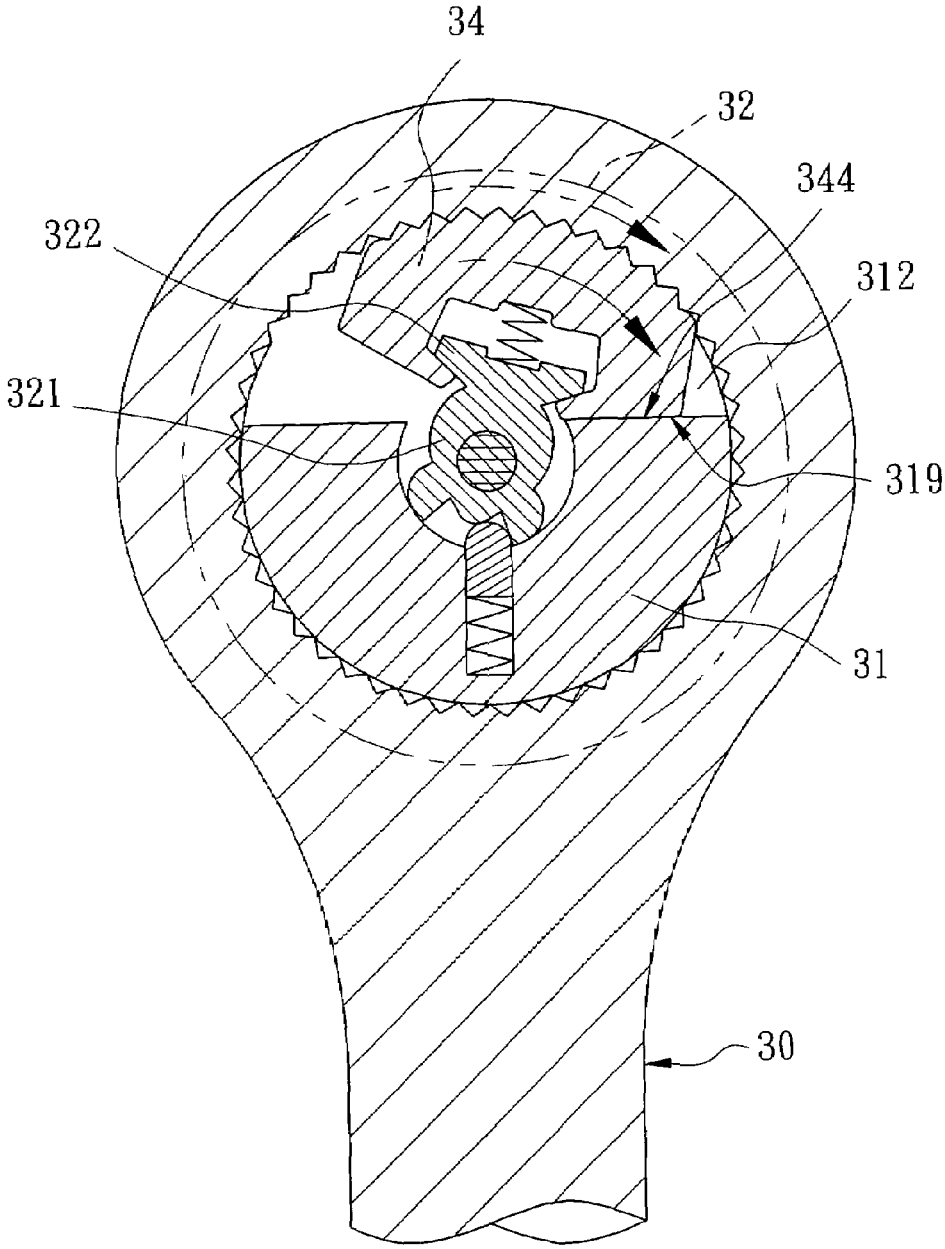
FIG. 13 is a view similar to FIG. 9 for illustrating an operation of switching direction of exerted force.

Referring to FIG. 13, a continuous clockwise rotation of the rotating disc 32 will clockwise pivot both the actuation member 322 and the locking member 34 to the right until the wall 344 contacts the wall 319. This finishes the switching of direction of exerted force. Note that the ratchet device 31 remains locked (i.e., motionless) in the above direction switch process. This means that it is possible of switching direction of exerted force by rotating the rotating disc 32 clockwise without holding the bar 311 with the other hand. As a result, the operation of switching direction of exerted force is more convenient.

Figure 14:
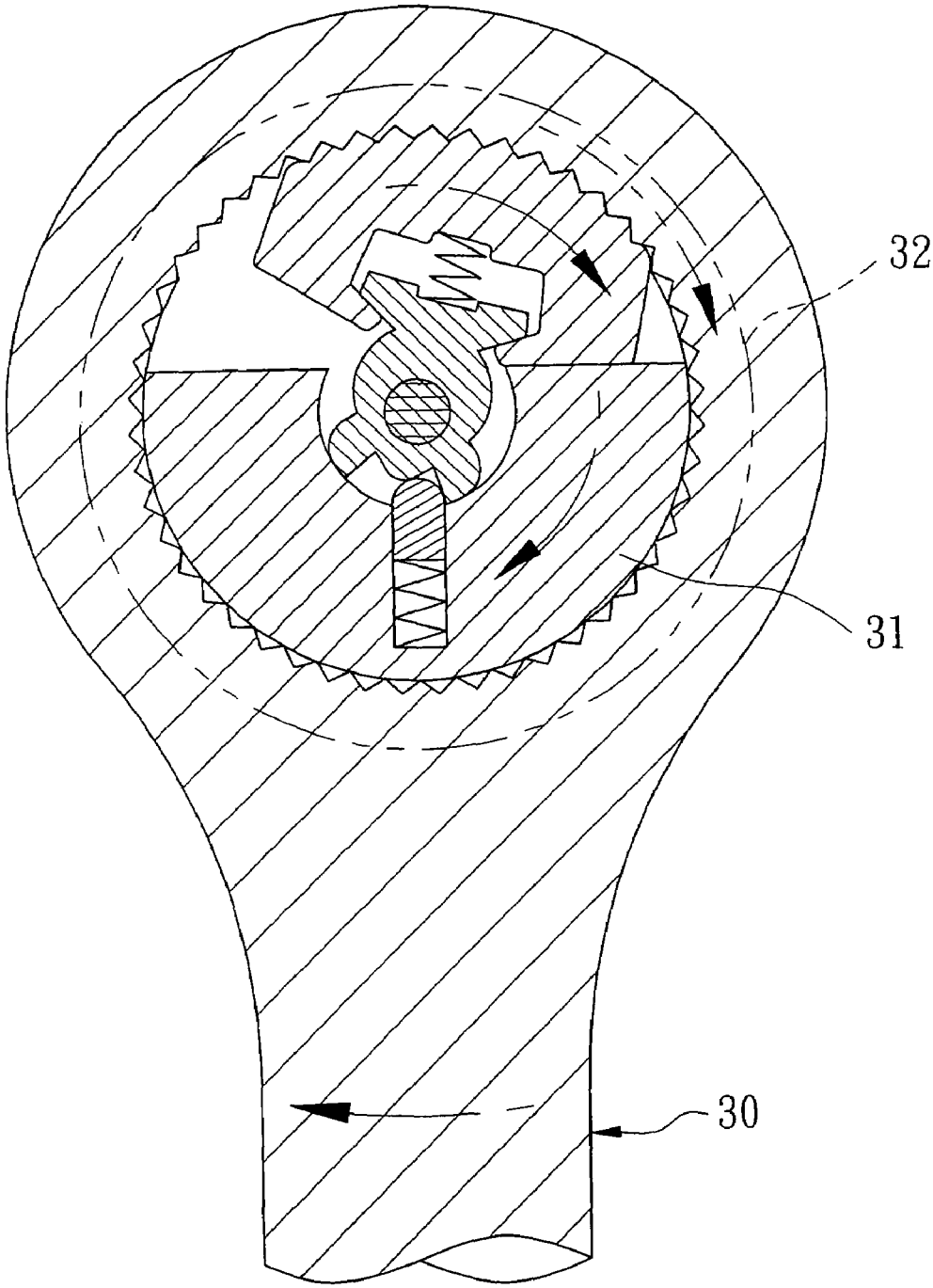
FIG. 14 is a view similar to FIG. 9 for illustrating a turning of the wrench after switching the direction of exerted force.

Referring to FIG. 14, after finishing the operation of switching direction of exerted force, a clockwise rotation of the handle 30 may cause the ratchet device 31 to clockwise rotate. As a result, the workpiece is tightened (i.e., fastened).

While the invention herein disclosed has been described by means of specific embodiments, numerous modifications and variations could be made thereto by those skilled in the art without departing from the scope and spirit of the invention set forth in the claims.

What is claimed is:

1. A ratchet wrench comprising:

a handle including an enclosed box portion at one and, the enclosed box portion having a ratchet around its interior surface;

a ratchet device provided in the box portion and including a bar extended downwardly, a laterally disposed recess having internal first and second walls, and an axial first bore in communication with the recess;

a rotating disc including a shaft extended downwardly into the first bore, ad an actuation member provided on one side of the shaft; and a locking member provided in the recess and including an outer ratchet adapted to engage with the ratchet of the handle, and inner groove for receiving and being engaged with the actuation member in the recess, and third and fourth walls provided at both sides of the groove, either the third wall being adapted to contact the first wall or the fourth wall being adapted to contact the second wall when the locking member pivots to one of left and right positions in the ratchet device;

wherein the shaft comprises two slots provided on one side opposite the actuation member, and the ratchet device further comprises a receptacle provided on an interior surface of the first bore, and a spring biased detent anchored in the receptacle such that rotating the rotating disc will switch an engagement of the detent with one slot to an engagement of the detent with the other slot for positioning;

whereby rotating the handle and the rotating disc in the same direction will cause both the locking member and the ratchet device to rotate the same; and rotating the rotating disc in a direction opposite to that the handle will switch a direction of force exerted upon a workpiece.

2. The ratchet wrench of claim 1, wherein the locking member further comprises a spring compressed between the groove and the actuation member for urging the locking member outwardly to engage the ratchet of the locking member with the ratchet of the handle.

3. The ratchet wrench of claim 1, wherein the ratchet device further comprises a second bore having a diameter smaller than that or the first bore, the second bore being in communication with the first bore and extended downwardly through the bar, a hole provided on a side of the bar, and a spring biased ball provided on the hole, and the rotating disc further comprises a third bore extended downwardly through the shaft, a spring biased pushing rod provided in the third bore, and an indentation provided on the pushing rod for receiving the spring biased ball when the pushing rod is pressed so as to disengage the bar from the coupled workpiece.

* * * * *